US011414886B2

(12) United States Patent
Nau et al.

(10) Patent No.: US 11,414,886 B2
(45) Date of Patent: Aug. 16, 2022

(54) WINDOW SECURITY DEVICE

(71) Applicant: PGT Innovations, Inc., North Venice, FL (US)

(72) Inventors: Michael Dietmar Nau, North Port, FL (US); Samuel Ray Bryant, Englewood, FL (US); Kurt Alfred Karussi, Osprey, FL (US)

(73) Assignee: PGT Innovations, Inc, North Venice, FL (US)

( * ) Notice: Subject to any disclaimer, the term of this patent is extended or adjusted under 35 U.S.C. 154(b) by 1045 days.

(21) Appl. No.: 16/046,520

(22) Filed: Jul. 26, 2018

(65) Prior Publication Data

US 2019/0211582 A1 Jul. 11, 2019

Related U.S. Application Data

(60) Provisional application No. 62/614,689, filed on Jan. 8, 2018.

(51) Int. Cl.
*E05B 13/10* (2006.01)
*E06B 1/70* (2006.01)
(Continued)

(52) U.S. Cl.
CPC ..... *E05B 13/10* (2013.01); *E05B 65/0835* (2013.01); *E05C 3/14* (2013.01);
(Continued)

(58) Field of Classification Search
CPC ..... E05B 13/10; E05B 65/0835; E05C 3/14; E05C 2007/007; E05C 19/06; Y10S 292/20; Y10S 292/47; E06B 3/4407; E06B 5/01; E06B 1/702; Y10T 292/1061; Y10T 292/1057; Y10T 292/1056; Y10T 292/1059; Y10T 292/1083;
(Continued)

(56) References Cited

U.S. PATENT DOCUMENTS 715,217 A * 12/1902 Sieffert ..... E05F 11/00 292/228
1,596,935 A * 8/1926 Marshall ..... E05C 19/00 160/211

(Continued)

FOREIGN PATENT DOCUMENTS

| | | |
|---|---|---|
| CN | 203783299 | 8/2014 |
| DE | 102006008099 | 3/2015 |
| JP | 2005232726 | 9/2005 |

OTHER PUBLICATIONS

Gordon Glass Co.; "STB Sliding Window Pulls and Latches", located at <https://web.archive.org/web/20180522212731/https://www.gordonglassusa.com/item/50-729/STB-Sliding-Window-Latch-and-Pull-Extruded-Aluminum-with-Spring-Black-1-13-16-50-729.html>, publicly available as early as May 22, 2018, 1 pg.

*Primary Examiner* — Christine M Mills
*Assistant Examiner* — Faria F Ahmad
(74) *Attorney, Agent, or Firm* — Taylor English Duma LLP

(57) ABSTRACT

A window security device includes a pull handle, the pull handle defining a tongue slot extending through the pull handle from a top paddle surface to a bottom paddle surface; and a locking bar slidably attached to the pull handle, a locking bar body of the locking bar positioned adjacent to the bottom paddle surface, a tongue of the locking bar extending through the tongue slot.

25 Claims, 15 Drawing Sheets

(51) Int. Cl.

| | |
|---|---|
| ***E05C 3/14*** | (2006.01) |
| ***E05B 65/08*** | (2006.01) |
| ***E06B 3/44*** | (2006.01) |
| ***E06B 5/11*** | (2006.01) |
| ***E05C 7/00*** | (2006.01) |
| ***E05C 19/06*** | (2006.01) |

(52) U.S. Cl.
CPC ..... *E06B 1/702* (2013.01); *E06B 3/4407* (2013.01); *E06B 5/11* (2013.01); *E05C 19/06* (2013.01); *E05C 2007/007* (2013.01); *Y10S 292/20* (2013.01); *Y10S 292/47* (2013.01); *Y10T 292/0891* (2015.04); *Y10T 292/0918* (2015.04); *Y10T 292/0934* (2015.04); *Y10T 292/1056* (2015.04); *Y10T 292/1057* (2015.04); *Y10T 292/1059* (2015.04); *Y10T 292/1061* (2015.04); *Y10T 292/1083* (2015.04)

(58) Field of Classification Search
CPC ..... Y10T 292/0891; Y10T 292/0918; Y10T 292/0934
See application file for complete search history.

(56) References Cited

U.S. PATENT DOCUMENTS 1,961,904 A * 6/1934 Meyer ..... E05C 3/14 292/228
2,523,727 A * 9/1950 Sevison ..... E05B 65/0835 292/128
3,050,322 A * 8/1962 Miller ..... E05C 3/14 292/114
3,070,856 A * 1/1963 Minick ..... E06B 3/4618 49/489.1
3,161,923 A * 12/1964 Crain ..... E05B 65/0835 292/128
3,266,830 A * 8/1966 Appleberry ..... E05C 3/14 292/128
3,288,508 A * 11/1966 Maize ..... E05C 3/14 292/128
3,797,870 A * 3/1974 Beckman ..... E05C 3/14 70/84
3,881,758 A * 5/1975 Gross ..... E05B 65/0835 292/87
3,893,261 A * 7/1975 Cribben ..... E05B 65/0835 49/449
3,942,286 A * 3/1976 Ehret ..... E05C 3/048 49/141
4,106,239 A 8/1978 Bancroft et al.
4,313,280 A * 2/1982 Ehret ..... B60J 1/14 292/87
4,428,154 A * 1/1984 Rinehart ..... E05C 17/24 292/276
4,461,500 A 7/1984 Van Der Horst
4,480,676 A * 11/1984 Solomon ..... E06B 9/82 160/272
4,542,924 A * 9/1985 Brown ..... E05C 19/06 292/87
4,803,808 A * 2/1989 Greisner ..... E06B 3/325 49/394
4,832,384 A * 5/1989 Venable ..... E05C 19/06 292/87
5,054,239 A * 10/1991 Tucker ..... E05F 11/16 49/279
5,152,103 A * 10/1992 Tucker ..... E05F 11/16 49/279
5,246,054 A * 9/1993 Shepherd ..... E06B 9/17046 160/133
5,292,191 A * 3/1994 Slivon ..... A47B 95/02 292/128
5,318,333 A * 6/1994 Dreifert ..... E05C 9/02 292/336.3
5,326,141 A * 7/1994 Gorman ..... E05B 63/20 292/173
5,342,102 A * 8/1994 Takimoto ..... E05B 65/0835 292/114
5,370,428 A * 12/1994 Dreifert ..... E05C 9/185 292/161
5,603,535 A * 2/1997 Antonucci ..... E05B 65/0835 292/128
5,697,655 A * 12/1997 Strong ..... E05C 3/14 292/230
5,769,517 A * 6/1998 Garde ..... E05B 65/0014 292/238
5,775,140 A * 7/1998 Hallsten ..... E05B 65/46 70/85
5,868,478 A * 2/1999 Yemini ..... A47B 95/02 312/332.1
6,094,865 A 8/2000 Weeks
6,367,853 B1 * 4/2002 Briggs ..... E05C 9/025 292/336.3
6,431,620 B2 * 8/2002 Tremblay ..... E05C 9/185 292/263
6,450,554 B1 * 9/2002 Rotondi ..... E05C 9/02 292/139
6,651,389 B2 * 11/2003 Minter ..... E05C 9/02 292/302
6,767,038 B1 * 7/2004 Huml ..... E05C 9/02 292/137
6,925,758 B2 * 8/2005 Pettit ..... E05B 17/2003 292/346
6,948,278 B1 * 9/2005 Schultz ..... E05B 65/0876 292/163
7,591,492 B2 9/2009 Nikkhah
8,177,265 B2 5/2012 Stevens
8,414,039 B2 4/2013 Liang et al.
8,418,404 B2 * 4/2013 Gramstad ..... E05C 17/28 49/141
8,491,022 B2 7/2013 Liebel et al.
8,550,507 B2 10/2013 Barton et al.
9,506,247 B2 * 11/2016 Feldpausch ..... E06B 1/18
10,844,650 B2 * 11/2020 Edlin ..... E05C 3/14
11,118,374 B2 * 9/2021 Minter ..... E05B 15/0006
2003/0001394 A1 * 1/2003 Colbert ..... E05C 3/14 292/87
2008/0012352 A1 * 1/2008 Eenigenburg ..... E05C 1/10 292/175
2008/0127567 A1 * 6/2008 Nikkhah ..... E05B 65/0835 49/404
2010/0066221 A1 * 3/2010 Hakemann ..... E05C 3/124 312/296
2011/0309730 A1 * 12/2011 Retchloff ..... E05C 3/14 312/332.1
2019/0211612 A1 * 7/2019 Vander Bent, Jr. ... E06B 3/5835
2020/0291696 A1 * 9/2020 Seki ..... B60R 7/04

* cited by examiner

WINDOW SECURITY DEVICE

CROSS-REFERENCE TO RELATED APPLICATIONS

This application claims the benefit of U.S. Provisional Application No. 62/614,689, filed on Jan. 8, 2018, which is hereby incorporated by reference in its entirety.

TECHNICAL FIELD

This disclosure relates to window frame assemblies. More specifically, this disclosure relates to a window security device for a window frame assembly.

BACKGROUND

Some hung windows utilize locking pull handles positioned at the bottom of a sash in order to lock the sash in a closed position against a window sill. With some designs, a burglar may be able to open, or "jimmy," the locked window from the outside by slipping a shim, coat hanger, "slim jim," or other device between the sash and the window sill and manipulating the pull handle. Additionally, pull handles can be inadvertently released such as by bumping against the pull handle. During manufacturing, shipping, or installation of the hung window, the hung window may be placed in a horizontal position. If the pull handles are inadvertently released with the hung window in the horizontal position, counterbalancing springs configured to reduce the weight of the sash in the vertical position can cause the sash to slingshot open, possibly causing damage to the hung window or injury to personnel.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a window security device comprising a pull handle, the pull handle defining a tongue slot extending through the pull handle from a top paddle surface to a bottom paddle surface; and a locking bar slidably attached to the pull handle, a locking bar body of the locking bar positioned adjacent to the bottom paddle surface, a tongue of the locking bar extending through the tongue slot.

Also disclosed is a window frame assembly comprising a window sill defining a sill locking rib; a rail defining a hand ledge; and a window security device, the window security device pivotably attached to the rail, the window security device selectively engaging the sill locking rib, the window security device comprising a pull handle; and a locking bar, the locking bar defining a tongue, an engagement end of the tongue positioned between the hand ledge and the pull handle.

Also disclosed is a method of operating a window frame assembly comprising a rail, a window sill, and a window security device, the method comprising positioning the rail in a closed position wherein the rail rests against the window sill; positioning the window security device in a locked position, the window security device pivotably attached to the rail, the window security device selectively pivotable about and between the locked position and an unlocked position, the rail vertically fixed relative to the window sill when the rail is in the closed position and the window security device is in the locked position; and repositioning a locking bar of the window security device to a secured position, the window security device prevented from pivoting to the unlocked position when the locking bar is in the secured position.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
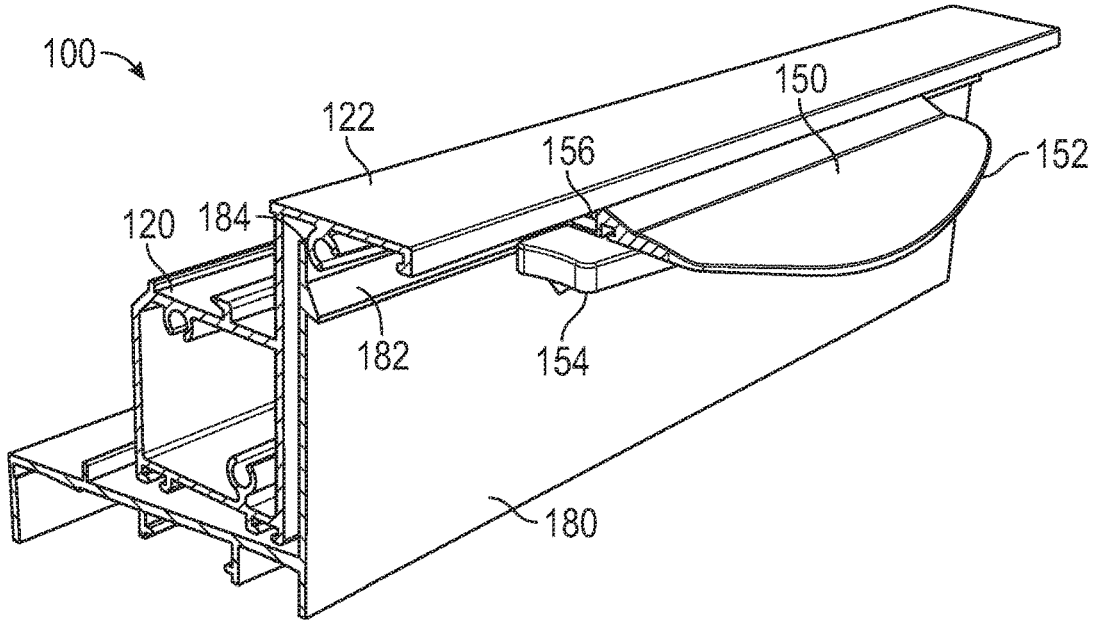
FIG. 1 is a perspective cross-sectional view of a window frame assembly comprising a window sill, a bottom rail, and a window security device in a locked position in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present discourse without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a window security device and associated methods, systems, devices, and various apparatus. The window security device can comprise a pull handle and a locking bar. It would be understood by one of skill in the art that the disclosed window security device is described in but a few exemplary aspects among many. No particular terminology or description should be considered limiting on the disclosure or the scope of any claims issuing therefrom.

FIG. 1 is a perspective cross-sectional view of a window frame assembly 100 comprising a window sill 180, a bottom rail 120, and a window security device 150 in accordance with one aspect of the present disclosure. The window security device 150 can comprise a pull handle 152 and a locking bar 154. The locking bar 154 can be slidably attached to the pull handle 152 and configured to slide or translate side-to-side relative to the pull handle 152. The window security device 150 can be configured to selectively pivot relative to a hand ledge 122 of the bottom rail 120 about and between a locked position (shown in FIG. 1) and an unlocked position (shown in FIG. 3). In the present aspect, the window security device 150 can optionally comprise a spring 156 which can be configured to bias the window security device 150 towards the locked position. In the present aspect, the spring 156 can be a leaf spring; however in other aspects, the spring 156 can be a different type of spring, such as a coil spring, torsion spring, or any other suitable spring.

The bottom rail 120 can be configured to move vertically relative to the window sill 180. The window security device 150 can be pivotably attached to the bottom rail 120. The window security device 150 can be configured to secure the bottom rail 120 in a closed position wherein the bottom rail 120 rests against the window sill 180 as shown in the present aspect. The hand ledge 122 of the bottom rail 120 can extend up and over a sill top 184 of the window sill 180. The window sill 180 can define a sill locking rib 182 disposed proximate to the sill top 184, and the window security device 150 can engage the sill locking rib 182 when the bottom rail 120 is in the closed position and the window security device 150 is in the locked position. With the window security device 150 engaging the sill locking rib 182, vertical movement of the bottom rail 120 relative to the window sill 180 can be prevented, and the bottom rail 120 can be vertically fixed relative to the window sill 180. With the window security device 150 in the unlocked position, the bottom rail 120 can be vertically movable relative to the window sill 180.

Figure 2:
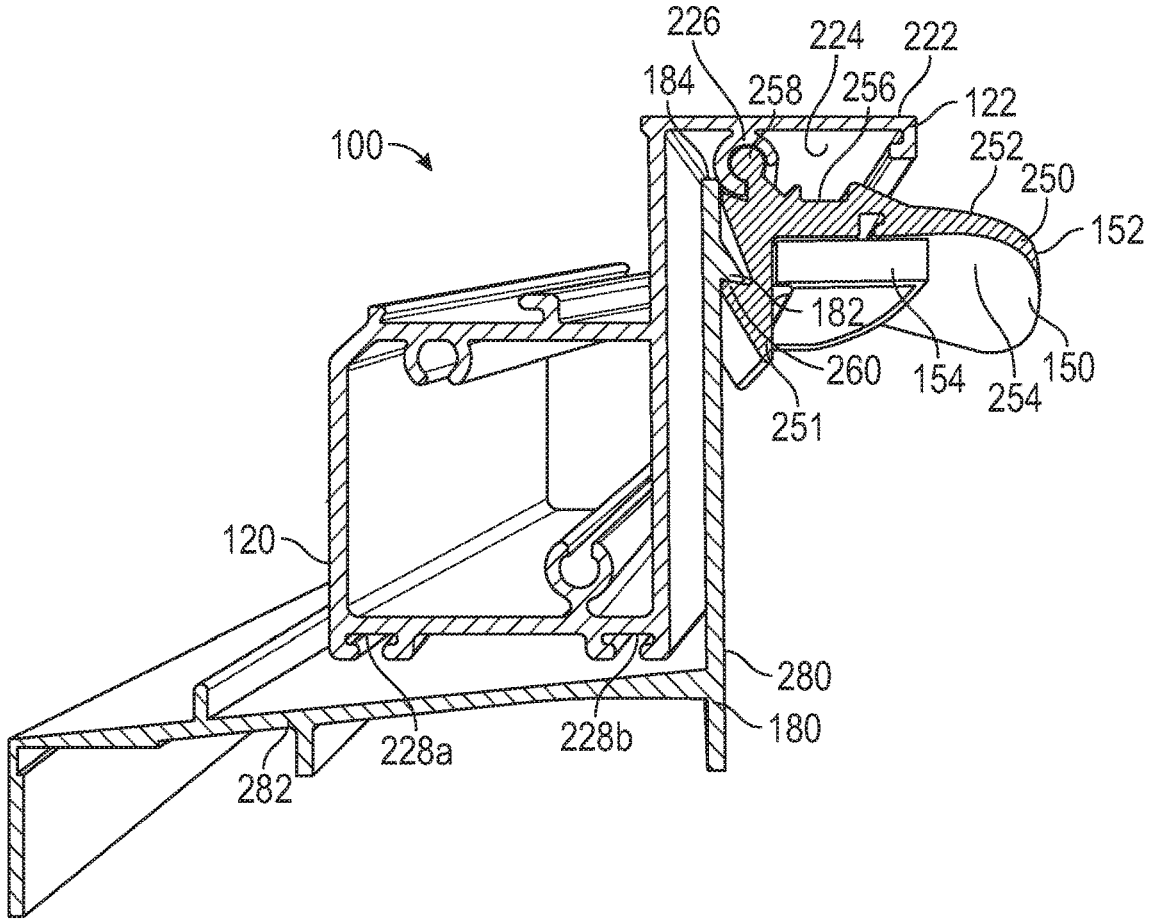
FIG. 2 is an end cross-sectional view of another aspect of the window frame assembly with the window security device in a locked position in accordance with another aspect of the present disclosure.

FIG. 2 is an end cross-sectional view of another aspect of the window frame assembly 100 with the window security device 150 in the locked position in accordance with another aspect of the present disclosure. The window frame assembly 100 of the present aspect can be substantially similar to the window frame assembly 100 of FIG. 1 with the exception that the window security device 150 of the present aspect does not comprise the optional spring 156 (shown in FIG. 1).

The window sill 180 can define a sill flange 280 and a sill ledge 282. The window sill 180 can be substantially L-shaped. The sill top 184 and the sill locking rib 182 can each be defined by the sill flange 280 which can extend upwards from the sill ledge 282. As shown and further described with respect to FIG. 13 below, the window sill 180 can be comprised by a window frame 1360 (shown in FIG. 13), and the bottom rail 120 can be comprised by a sash 1310 (shown in FIG. 13). The bottom rail 120 can be configured to seal against the sill ledge 282, and in the present aspect, the bottom rail 120 can define a pair of slots 228*a,b* configured to receive weather strips (not shown) to promote sealing between the bottom rail 120 and the sill ledge 282. The hand ledge 122 can extend up and over the sill flange 280 and can be configured to provide a grip for a user to raise and lower the sash 1310 relative to the window frame 1360.

The hand ledge 122 can define a top ledge surface 222 and a bottom ledge surface 224 disposed opposite from the top ledge surface 222. The bottom ledge surface 224 can face the sill top 184. The pull handle 152 can define a paddle portion 250 and a lever portion 251. The paddle portion 250 and the lever portion 251 can be substantially L-shaped. With the window security device 150 in the locked position as shown, the paddle portion 250 can extend substantially parallel to the hand ledge 122, and the lever portion 251 can extend substantially parallel to the sill flange 280. The paddle portion 250 can define a top paddle surface 252 and a bottom paddle surface 254 disposed opposite from the top paddle surface 252. The top paddle surface 252 can face the bottom ledge surface 224.

The hand ledge 122 can define a C-channel rib 226 disposed on the bottom ledge surface 224. The pull handle 152 can define a pivot boss 258 extending upwards from the top paddle surface 252 proximate to an intersection between the lever portion 251 and the paddle portion 250. The C-channel rib 226 can receive the pivot boss 258 to pivotably attach the window security device 150 to the bottom rail 120. With the pivot boss 258 engaging the C-channel rib 226, the window security device 150 can selectively pivot about and between the locked position shown and the unlocked position (shown in FIG. 3). The top paddle surface 252 can define a spring groove 256, and in aspects comprising the spring 156 (shown in FIG. 1), the spring 156 can rest in the spring groove 256 and press upon the bottom ledge surface 224 to bias the window security device 150 towards the locked position.

The lever portion 251 of the pull handle 152 can define a handle locking rib 260 extending outwards from the lever portion 251 and towards the sill flange 280. With the bottom rail 120 in the closed position and the window security device 150 in the locked position, the handle locking rib 260 can engage the sill locking rib 182 to prevent upwards vertical motion of the bottom rail 120 relative to the window sill 180.

Figure 3:
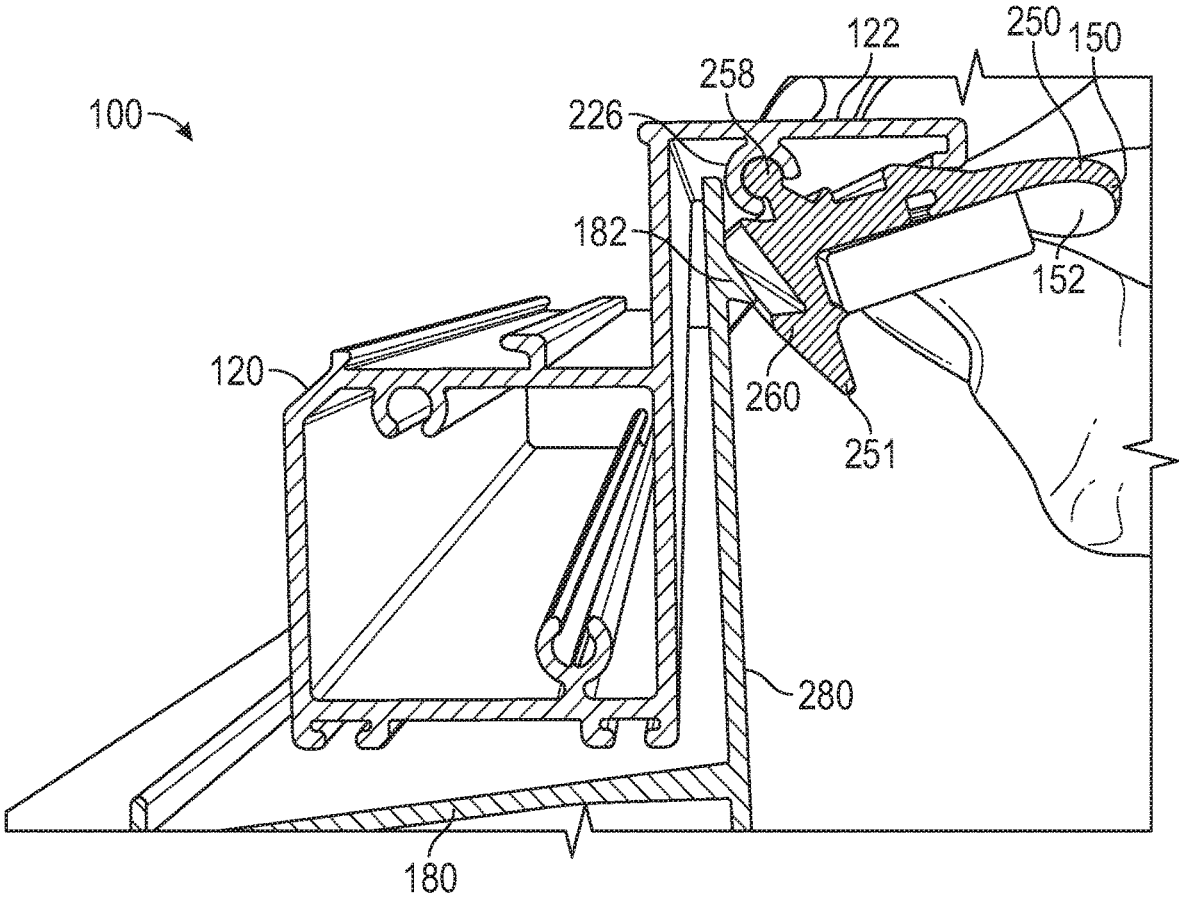
FIG. 3 is an end cross-sectional view of the window frame assembly of FIG. 2 with the window security device in an unlocked position.

FIG. 3 is an end cross-sectional view of the window frame assembly 100 of FIG. 2 with the window security device 150 in the unlocked position in which the bottom rail 120 is vertically movable relative to the window sill 180. The window security device 150 can be repositioned from the locked position to the unlocked position by pulling upwards on the paddle portion 250 of the pull handle 152 to pivot the paddle portion 250 towards the hand ledge 122. As the pull handle 152 pivots within the C-channel rib 226 about the pivot boss 258, the lever portion 251 of the pull handle 152 rotates away from the sill flange 280 until the handle locking rib 260 disengages from the sill locking rib 182. With the handle locking rib 260 disengaged from the sill locking rib 182, the bottom rail 120 can be vertically raised relative to the window sill 180, thereby allowing the window frame assembly 100 to be opened. In the present aspect, the paddle portion 250 of the pull handle 152 can contact the hand ledge 122 in the unlocked position to provide a positive stop for the window security device 150. In other aspects, the paddle portion 250 may not contact the hand ledge 122 in the unlocked position.

Figure 4:
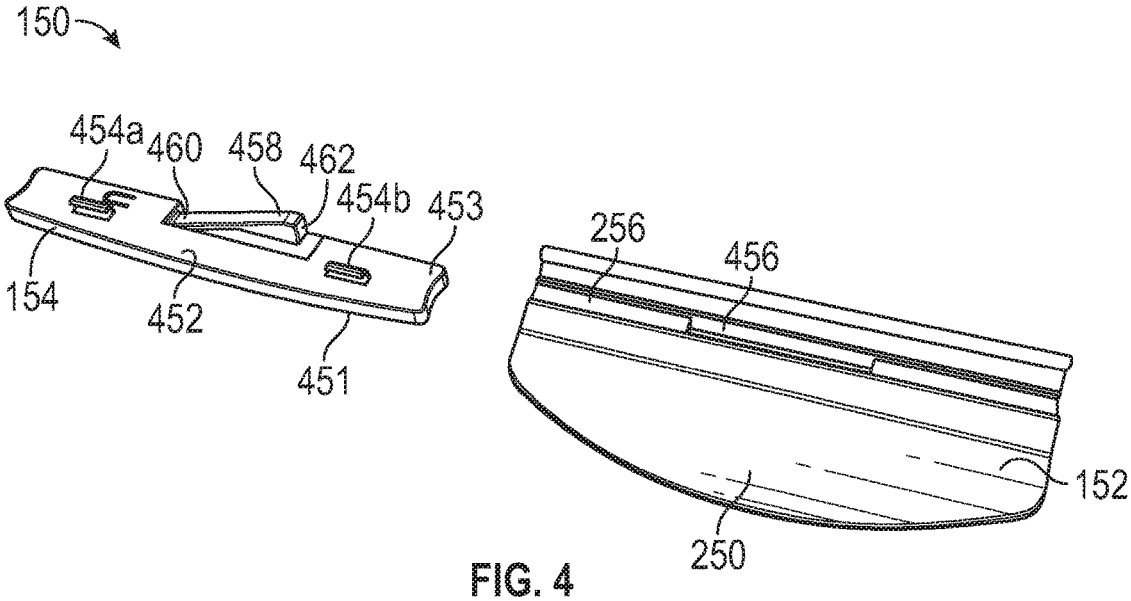
FIG. 4 is an exploded perspective view of the window security device of the window frame assembly of FIG. 2.

FIG. 4 is an exploded perspective view of the window security device 150 of the window frame assembly 100 of FIG. 2. The locking bar 154 comprises a locking bar body 452 and a tongue 458. The locking bar body 452 can define a top body surface 453 and a bottom body surface 451 disposed opposite from the top body surface 453. The tongue 458 can extend upwards and away from the top body surface 453. The locking bar body 452 can be attached to a base end 460 of the tongue 458. The tongue 458 can define an engagement end 462 disposed opposite from the base end 460. In the present aspect, the window security device 150 can be a springless design which does not comprise a spring. The tongue 458 can be thin and flexible proximate to the base end 460, and the tongue 458 can elastically deform at the base end 460 to move the engagement end 462 towards the top body surface 453. In the present aspect, the tongue 458 can elastically deform so that the tongue 458 can be flush with the top body surface 453 of the locking bar body 452.

The locking bar body 452 can define a pair of guide lugs 454*a,b* extending upwards from the top body surface 453. The guide lugs 454*a,b* can be configured to attach the locking bar 154 to the pull handle 152. The pull handle 152 can define a tongue slot 456 extending through the paddle portion 250 of the pull handle 152. In the present aspect, the tongue slot 456 can be aligned with the spring groove 256. With the locking bar 154 attached to the pull handle 152, the engagement end 462 of the tongue 458 can extend through the tongue slot 456 as shown and further described below with respect to FIG. 5, FIG. 6, and FIG. 10.

Figure 5:
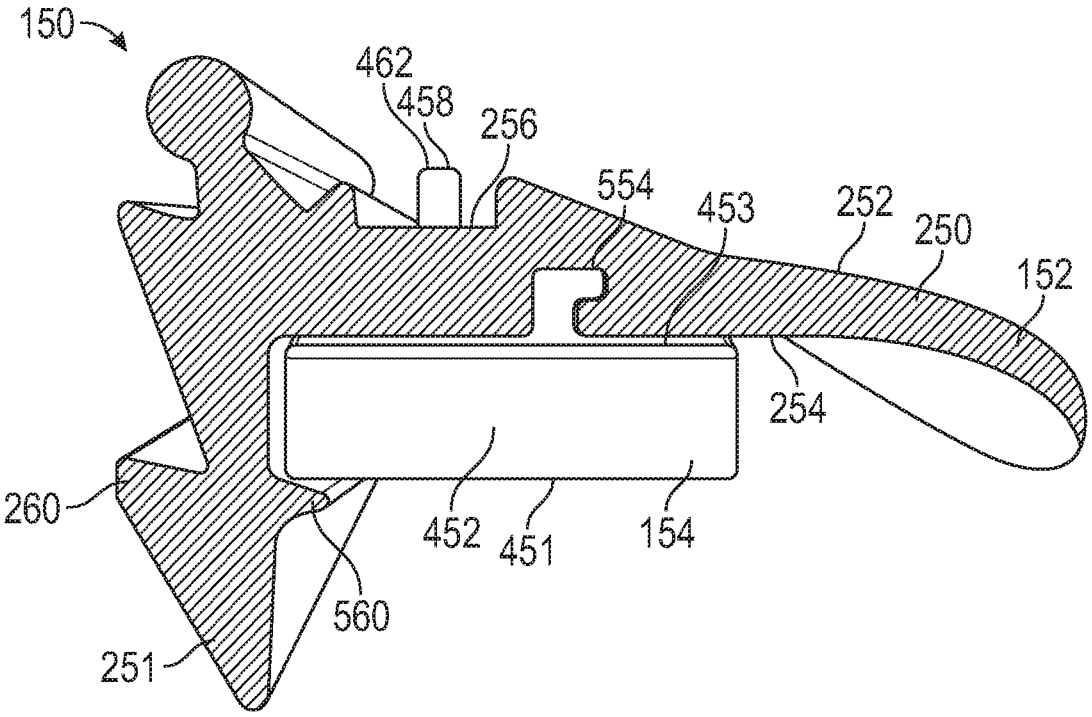
FIG. 5 is an end view of the window security device of the window frame assembly of FIG. 2.

FIG. 5 is an end view of the window security device 150 of the window frame assembly 100 of FIG. 2. As shown, the engagement end 462 of the tongue 458 can extend through the tongue slot 456 (shown in FIG. 4) so that the tongue 458 extends upwards from the top paddle surface 252 and out from the spring groove 256. The bottom paddle surface 254 can define a lug slot 554 extending into the paddle portion 250 of the pull handle 152. The guide lugs 454*a,b* (shown in FIG. 4) of the locking bar body 452 can engage the lug slot 554 to secure the top body surface 453 in facing contact with the bottom paddle surface 254. Engagement between the guide lugs 454*a,b* and the lug slot 554 can permit the locking bar 154 to slide lengthwise relative to the pull handle 152. The guide lugs 454*a,b* can be configured to slide or translate within the lug slot 554. The locking bar 154 can be selectively positionable about and between a release position (shown in FIG. 6) in which the engagement end 462 aligns with the tongue slot 456 (shown in FIG. 4), and a secured position (shown in FIG. 10) in which the engagement end 462 overlaps with the spring groove 256 and is misaligned with the tongue slot 456.

The lever portion 251 can also define a bar lug 560 which can extend outwards from the lever portion 251 opposite from the handle locking rib 260 to engage and support the bottom body surface 451 of the locking bar body 452.

Figure 6:
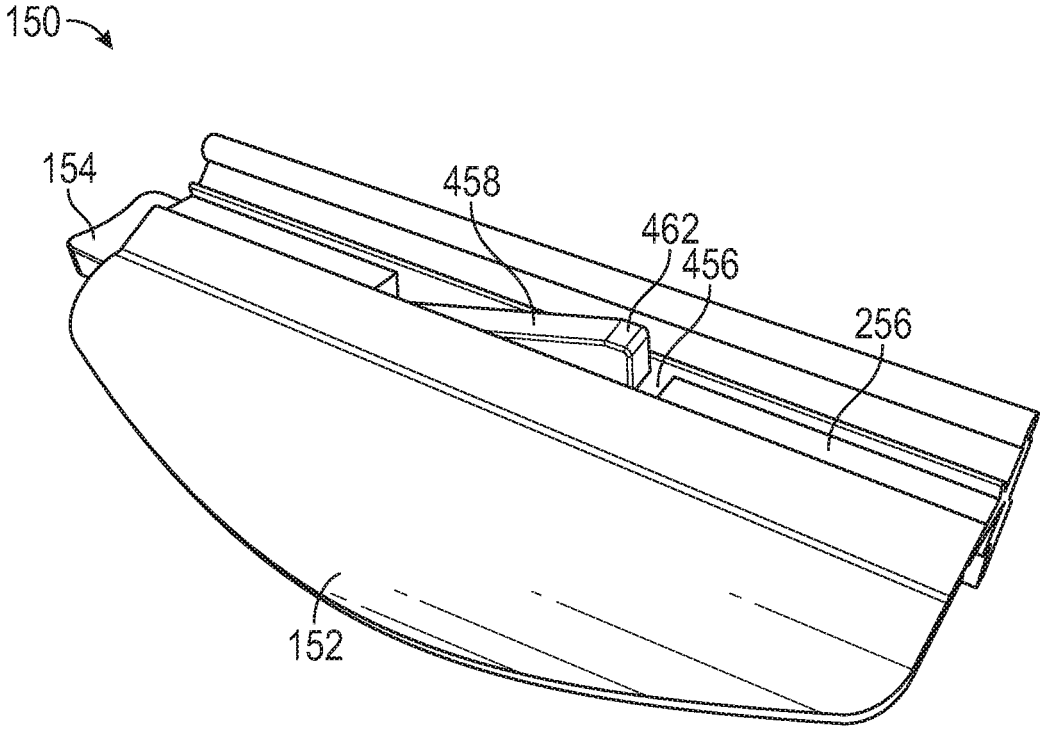
FIG. 6 is a perspective view of the window security device of the window frame assembly of FIG. 2 with a locking bar of the window security device in a release position.
Figure 8:
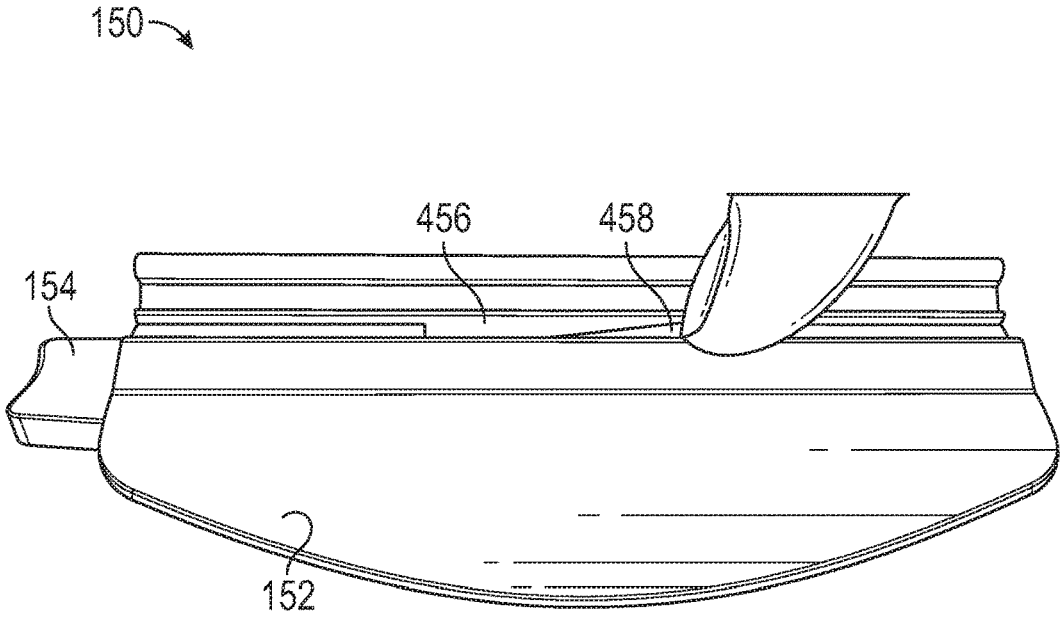
FIG. 8 is a front perspective view of the window security device of the window frame assembly of FIG. 2 with a finger of a user depressing a tongue of the window security device.

FIG. 6 is a perspective view of the window security device 150 of the window frame assembly 100 of FIG. 2 with the locking bar 154 in the release position. With the locking bar 154 in the release position, the engagement end 462 of the tongue 458 can align with the tongue slot 456, and the tongue 458 can be depressed downwards into the tongue slot 456, as shown in FIG. 8.

Figure 7:
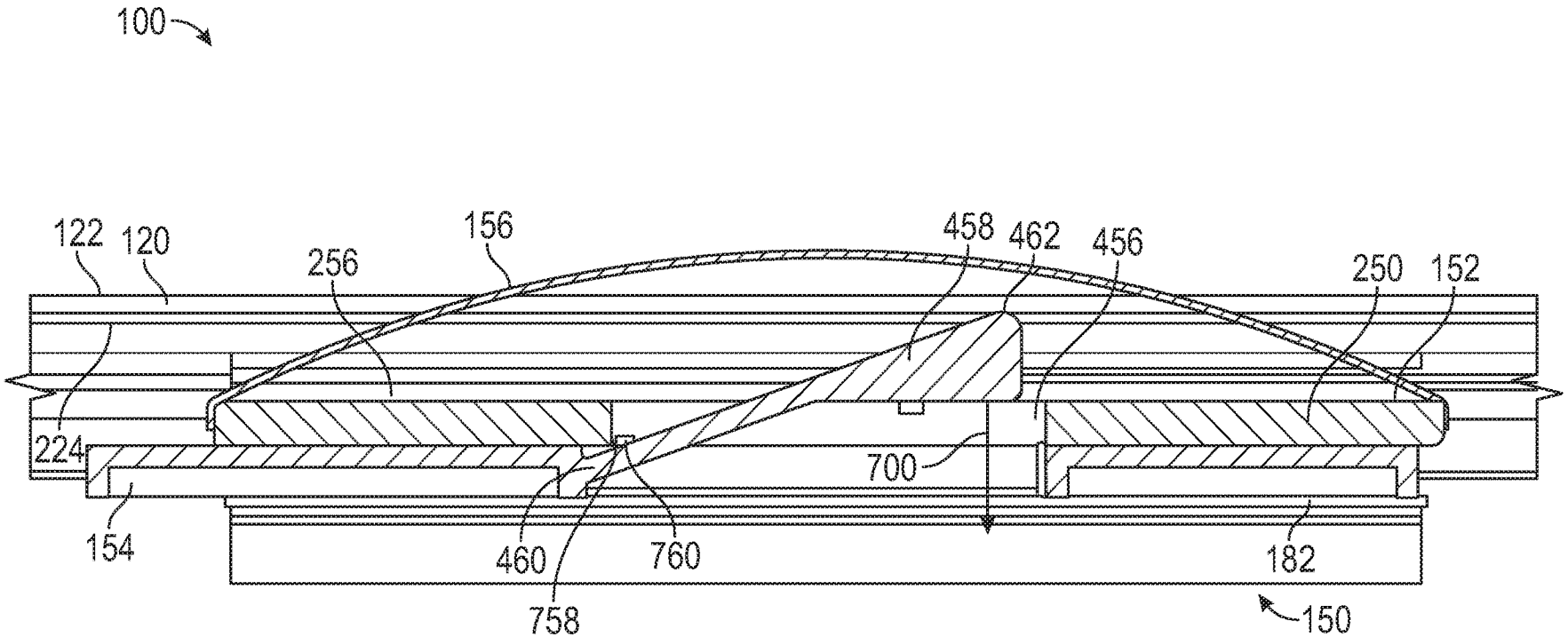
FIG. 7 is a front cross-sectional view of the window frame assembly of FIG. 1 with the window security device in the locked position and the locking bar in the release position.

FIG. 7 is a front cross-sectional view of the window frame assembly 100 of FIG. 1 with the window security device 150 in the locked position and the locking bar 154 in the release position. In the present aspect, the window security device 150 can be a sprung design which comprises the spring 156. In the present aspect, the spring 156 is shown extending through the hand ledge 122 of the bottom rail 120; however in an actual production sample, the spring 156 can engage the bottom ledge surface 224 of the hand ledge 122 to bias the window security device 150 towards the locked position. Additionally, the engagement end 462 of the tongue 458 can engage the bottom ledge surface 224 of the hand ledge 122 and the resilience of the tongue 458 can additionally bias the window security device 150 towards the locked position. In aspects which do not comprise the optional spring 156, the tongue 458 can be shaped and sized to exert an adequate biasing force upon the hand ledge 122 in the absence of the spring 156 to reduce incidental disengagement of the window security device 150.

With the locking bar 154 in the release position, the window security device 150 can be selectively pivoted about and between the locked position and the unlocked position. In the release position, the engagement end 462 of the tongue 458 can be positioned between the bottom ledge surface 224 and the tongue slot 456. When selectively pivoting the window security device 150 towards the unlocked position, the engagement end 462 of the tongue 458 can depress into the tongue slot 456 as shown by a directional arrow 700, thereby providing clearance for the paddle portion 250 of the pull handle 152 to pivot towards the hand ledge 122.

The tongue 458 can also define a release position stop 760 extending upwards from the tongue 458 proximate to the base end 460 and into the tongue slot 456. The release position stop 760 can be configured to limit travel of the locking bar 154 past the release position by engaging with an edge 758 of the tongue slot 456. The release position stop 760 can also resist withdrawal of the locking bar 154 from the pull handle 152 to prevent accidental disassembly of the window security device 150.

FIG. 8 is a front perspective view of the window security device 150 of the window frame assembly of FIG. 2 which demonstrates the ability of the tongue 458 to be depressed into the tongue slot 456 when the locking bar 154 is in the release position. As shown, the tongue 458 can be depressed by a finger of a user for demonstration purposes.

Figure 9:
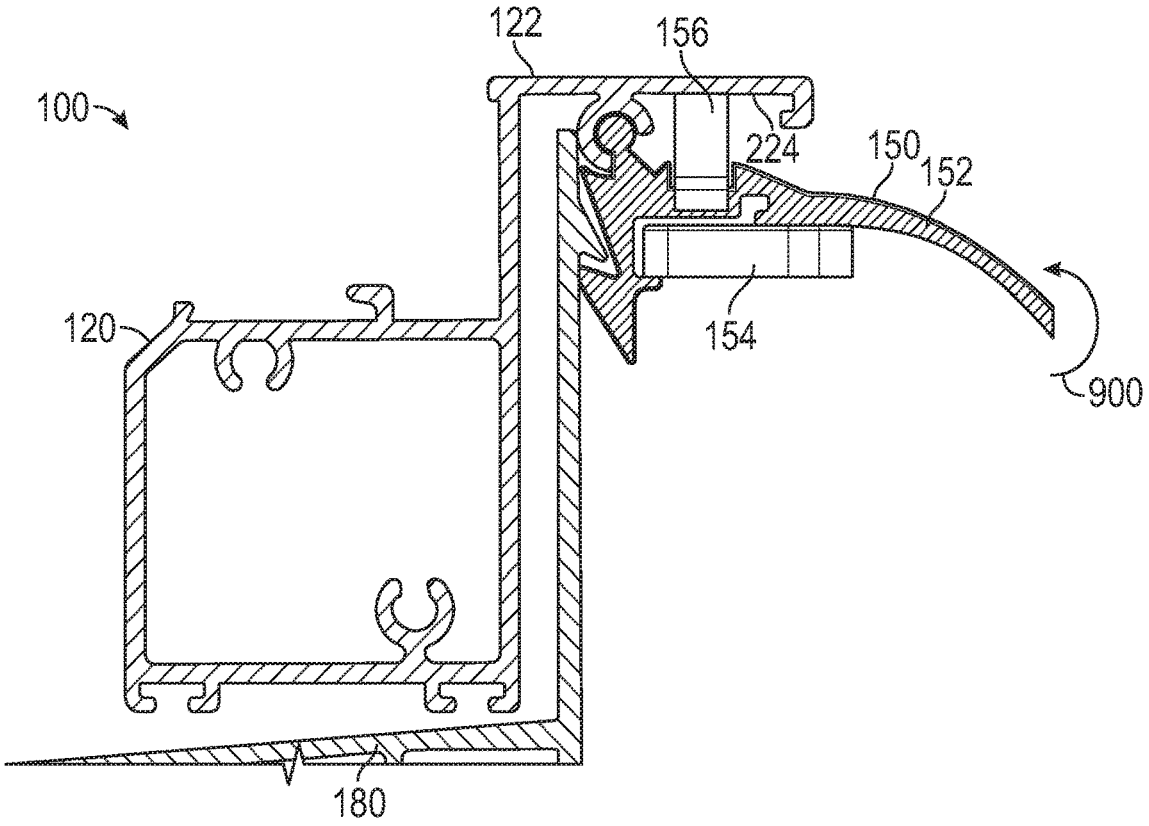
FIG. 9 an end cross-sectional view of the window frame assembly of FIG. 1 with the window security device in the locked position and the locking bar in the release position.

FIG. 9 is an end cross-sectional view of the window frame assembly 100 of FIG. 1 with the window security device 150 in the locked position and the locking bar 154 in the release position. Directional arrow 900 demonstrates that the window security device 150 can be pivoted from the locked position to the unlocked position when the locking bar 154 is in the release position. The current aspect also demonstrates that the spring 156 can engage the bottom ledge surface 224 of the hand ledge 122 to bias the window security device 150 towards the locked position as previously described. Pivoting the window security device 150 to the unlocked position along directional arrow 900 can required a user to overcome the biasing force exerted by the spring 156.

Figure 10:
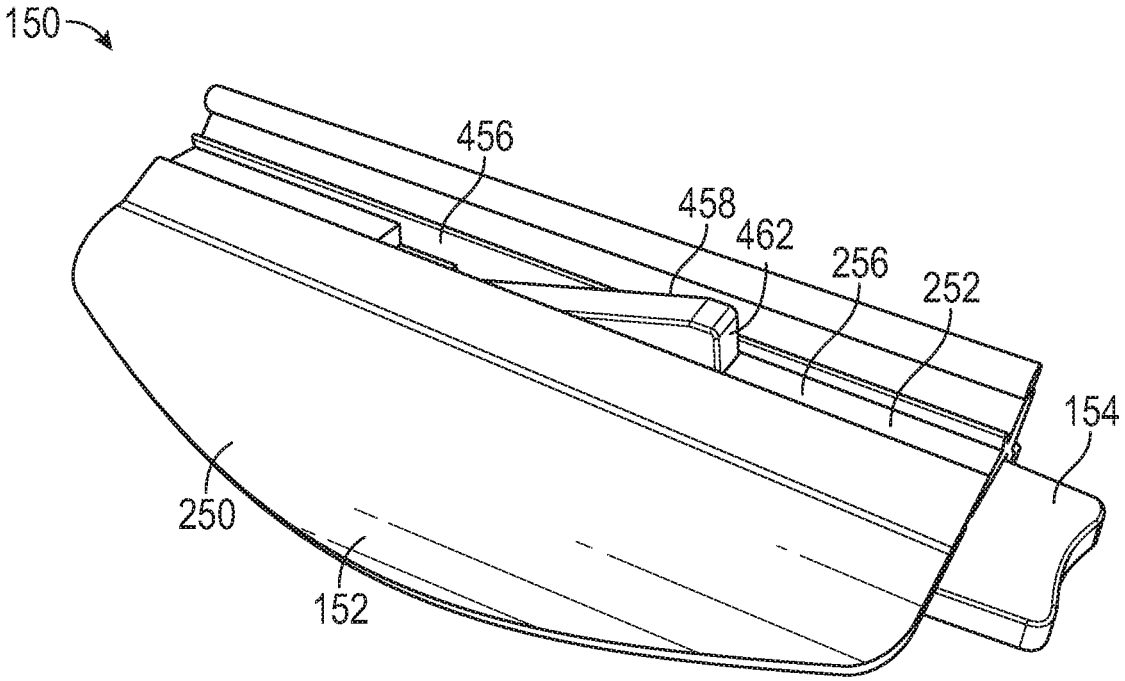
FIG. 10 is perspective view of the window security device of the window frame assembly of FIG. 2 with the locking bar in a secured position.

FIG. 10 is perspective view of the window security device 150 of the window frame assembly 100 of FIG. 2 with the locking bar 154 in the secured position. In the secured position, the engagement end 462 of the tongue 458 can be misaligned with the tongue slot 456, and the engagement end 462 of the tongue 458 can be supported within the spring groove 256 by the top paddle surface 252 of the paddle portion 250 of the pull handle 152. In the secured position, the tongue 458 cannot be depressed into the tongue slot 456 because of interference between the engagement end 462 and the top paddle surface 252.

Figure 11:
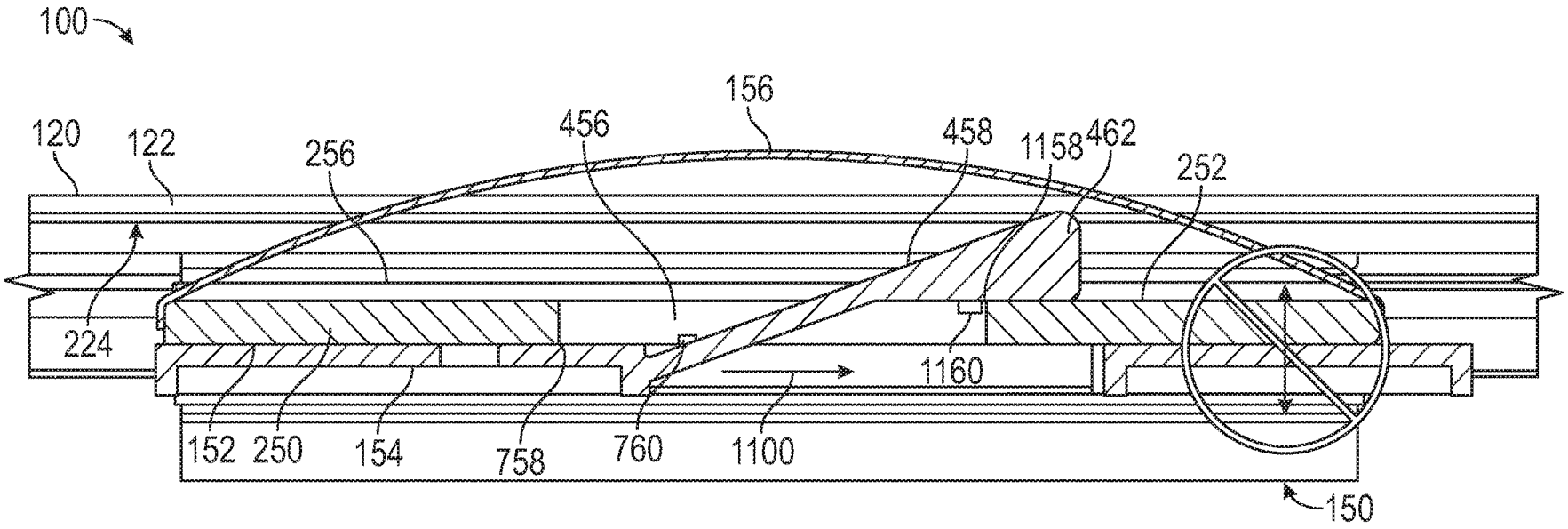
FIG. 11 is a front cross-sectional view of the window frame assembly of FIG. 1 with the window security device in the locked position and the locking bar in the secured position.

FIG. 11 is a front cross-sectional view of the window frame assembly 100 of FIG. 1 with the window security device 150 in the locked position and the locking bar 154 in the secured position. In the secured position, the engagement end 462 of the tongue 458 can be misaligned from the tongue slot 456, and the engagement end 462 can be positioned between the top paddle surface 252 of the paddle portion 250 of the pull handle 152 and the bottom ledge surface 224 of the hand ledge 122 of the bottom rail 120. With the engagement end 462 positioned between the paddle portion 250 and the hand ledge 122, the paddle portion 250 cannot be pivoted towards the hand ledge 122, thereby securing the window security device 150 in the locked position.

The locking bar 154 can be repositioned from the release position to the secured position by sliding or translating the locking bar 154 relative to the pull handle 152 in an engagement direction 1100 until a secured position stop 1160 of the tongue 458 contacts an edge 1158 of the tongue slot 456. As shown, the secured position stop 1160 can be defined by the tongue 458, and the secured position stop 1160 can extend downwards into the tongue slot 456. The locking bar 154 can be repositioned from the secured position to the release position by sliding the locking bar 154 in a disengagement direction (not shown) defined opposite from the engagement direction 1100, until the release position stop 760 contacts the edge 758 of the tongue slot 456. In other aspects, the sliding motion can comprise a rotational motion. For example and without limitation, the tongue 458 can be rotated about and between the release position and the secured position by rotating the tongue 458 into and out of alignment with the tongue slot 456, respectively.

Figure 12:
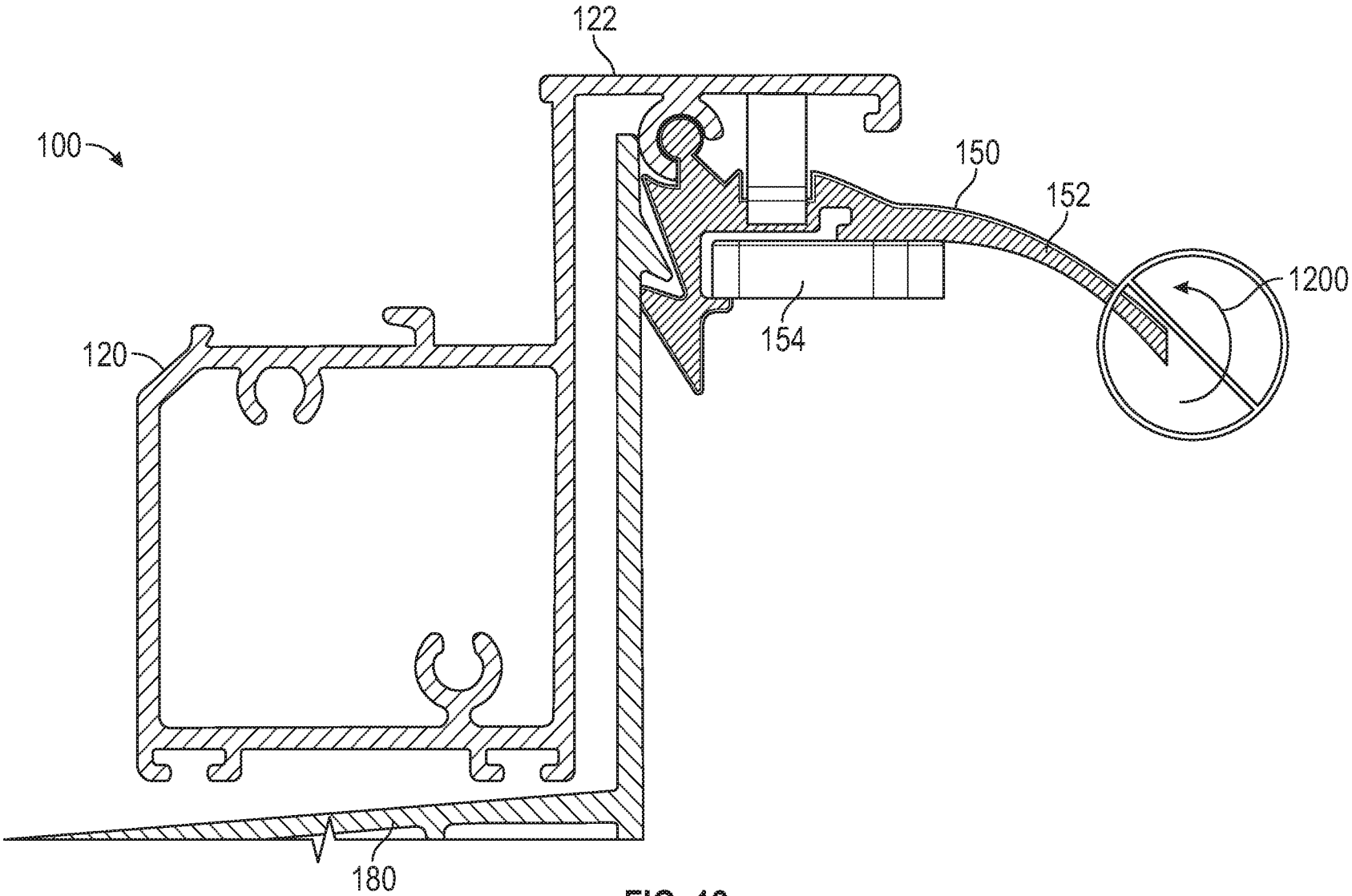
FIG. 12 is an end cross-sectional view of the window frame assembly of FIG. 1 with the window security device in the locked position and the locking bar in the secured position.

FIG. 12 is an end cross-sectional view of the window frame assembly 100 of FIG. 1 with the window security device 150 in the locked position and the locking bar 154 in the secured position. With the locking bar 154 in the secured position, the window security device 150 cannot be pivoted along directional arrow 1200 from the locked position to the unlocked position. Therefore, when the locking bar 154 is in the secured position, the window security device 150 can be secured in the locked position, thereby prevent incidental unlocking of the window security device 150 from the window sill 180.

Figure 13:
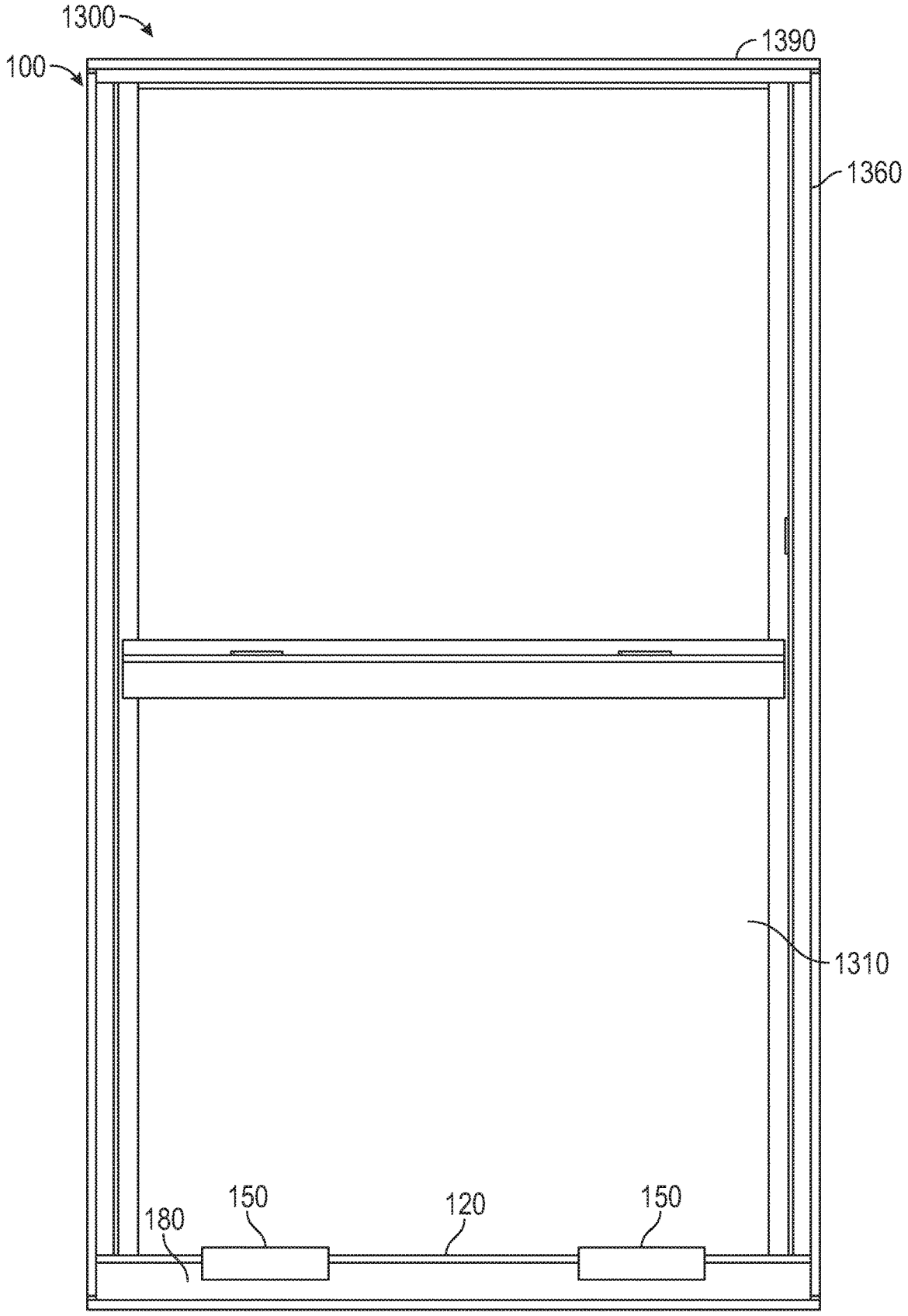
FIG. 13 is a front view of another aspect of the window frame assembly wherein the window frame assembly can be a hung window in accordance with another aspect of the present disclosure.

FIG. 13 is a front view of another aspect of the window frame assembly 100 wherein the window frame assembly 100 can be a hung window 1300 in accordance with another aspect of the present disclosure. The hung window 1300 can comprise the sash 1310 and the window frame 1360. The sash 1310 can comprise the bottom rail 120, and the window frame 1360 can comprise the window sill 180. The sash 1310 can be configured to slide vertically upwards and downwards within the window frame 1360 to open and close the window. In the present aspect, the sash 1310 is shown in the closed position. In the present aspect, the hung window 1300 can comprise multiple window security devices 150; however, in other aspects of the window frame assembly 100, the window frame assembly 100 may only comprise a single window security device 150.

With the window security device 150 in the locked position, the sash 1310 can be secured in the closed position, and the hung window 1300 cannot be opened without pivoting the pull handle 152 (shown in FIG. 1) as previously discussed. The locking bar 154 (shown in FIG. 1) can act as a secondary locking mechanism which can secure the window security device 150 in the locked position. The secondary locking action can increase the security of a home or building by making the hung window 1300 more difficult to open from the outside. For example, without the locking bar 154, a burglar may be able to pivot the pull handle 152 from the outside with a shim, coat hanger, or other device, thereby allowing the burglar to open a locked window. With the locking bar 154 in the secured position, the pull handle 152 cannot be pivoted to unlock the hung window 1300. Therefore, the locking bar 154 can provide a secondary locking mechanism to the window security device 150.

Additionally, hung windows 1300 can comprise springs (not shown) which can be configured to counterbalance a weight of the sash 1310 in order to facilitate sliding the sash 1310 upwards to open the hung window 1300. When the hung window 1300 is in a vertical position, such as when installed in a home, the weight of the sash 1310 balances with the springs. However, when the hung window 1300 is in a horizontal position, such as during manufacturing, storage, transportation, or prior to installation, the force of gravity does not act on the sash 1310 to counter the springs. Consequently, if the window security device 150 is released while the hung window 1300 is in a horizontal position, the springs can slingshot the sash 1310 towards a head jamb 1390 of the window frame 1360, possibly causing damage to the hung window 1300 or injury to personnel handling the hung window 1300. In some aspects, such as those in which the sash 1310 comprises an insulating glass unit, reinforced glass, or another heavy lite or is a large sash 1310, the sash 1310 can be very heavy, and the counterbalancing springs can be very powerful, potentially increasing the possibility of injury or damage. By positioning the locking bar 154 in the secured position, inadvertent unlocking of the window security devices 150 can be prevented, thereby increasing safety of the hung window 1300.

The window security device 150 can also be utilized in a vertical orientation, such as for a horizontal roller window wherein the sash 1310 is configured to slide side-to-side instead of up and down.

Figure 14:
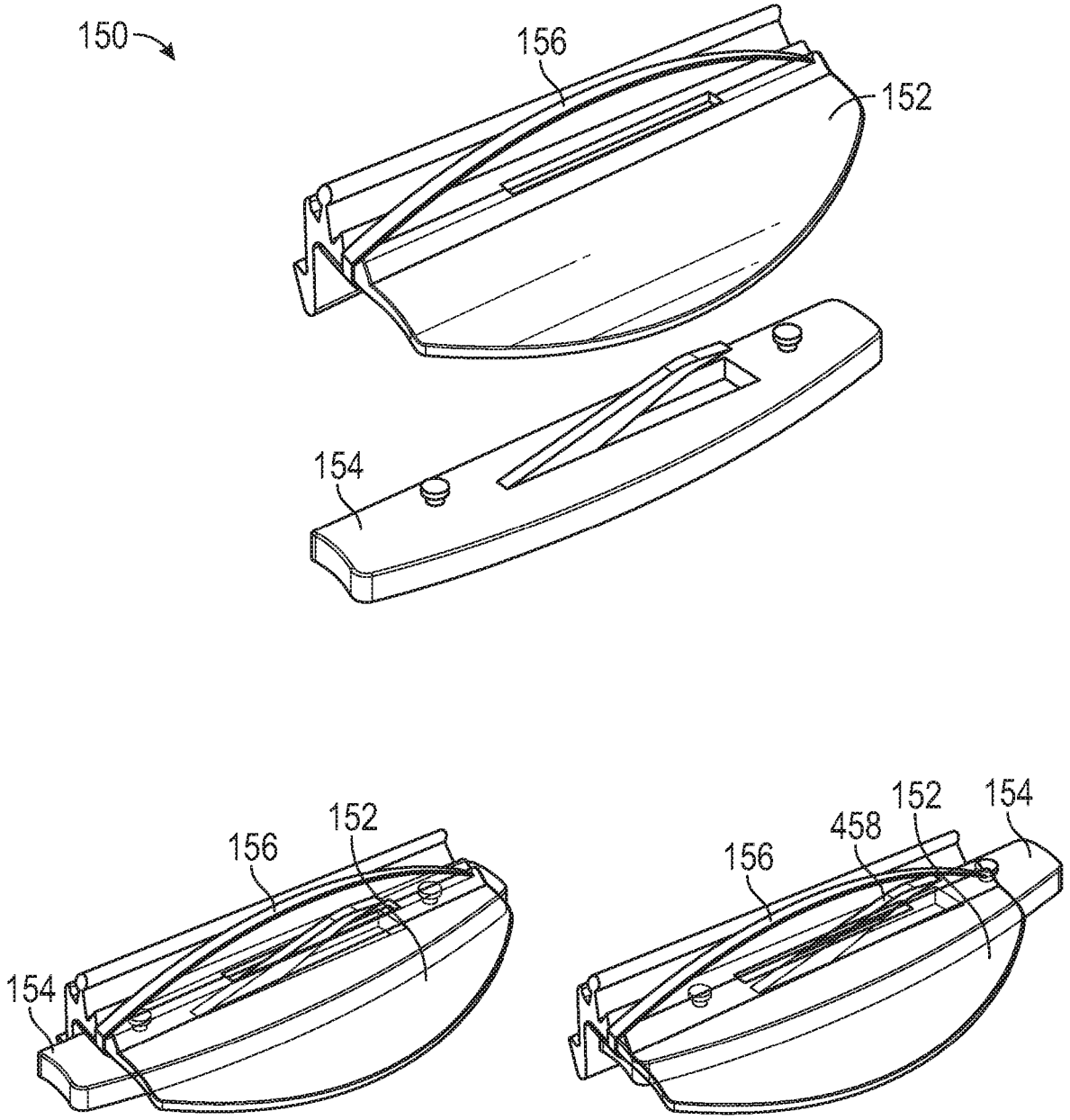
FIG. 14 is a perspective view of another aspect of the window security device in accordance with another aspect of the present disclosure wherein an engagement end of the tongue is tapered, and the tongue is attached to a top body surface of the locking bar.

FIG. 14 is a perspective view of another aspect of the window security device 150 in accordance with another aspect of the present disclosure. In the present aspect, the tongue 458 can be configured to engage the spring 156 to prevent the window security device 150 from pivoting from the locked position to the unlocked position. The engagement end of the tongue can be tapered, and the tongue can attach to the top body surface of the locking bar.

Figure 15:
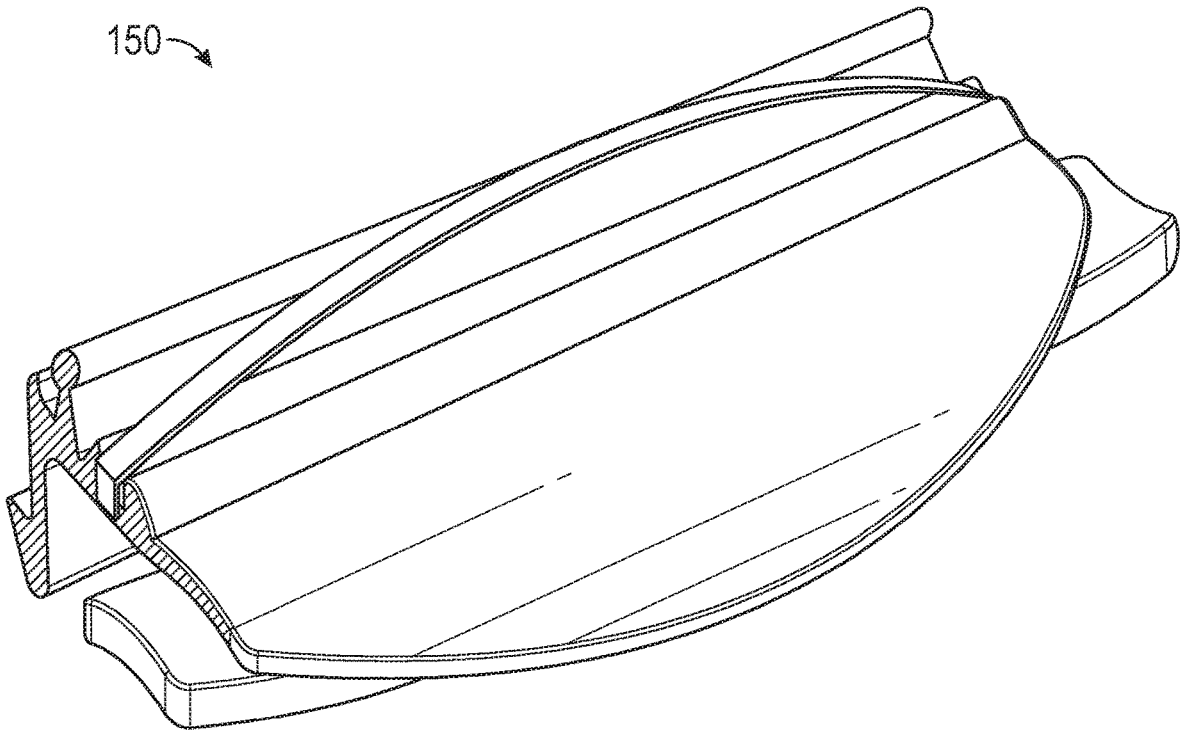
FIG. 15 is a perspective view of another aspect of the window security device in accordance with another aspect of the present disclosure.

FIG. 15 is a perspective view of another aspect of the window security device 150 in accordance with another aspect of the present disclosure. The locking bar 154 can define a concave underside for easy finger grip or finger hold.

Figure 16:
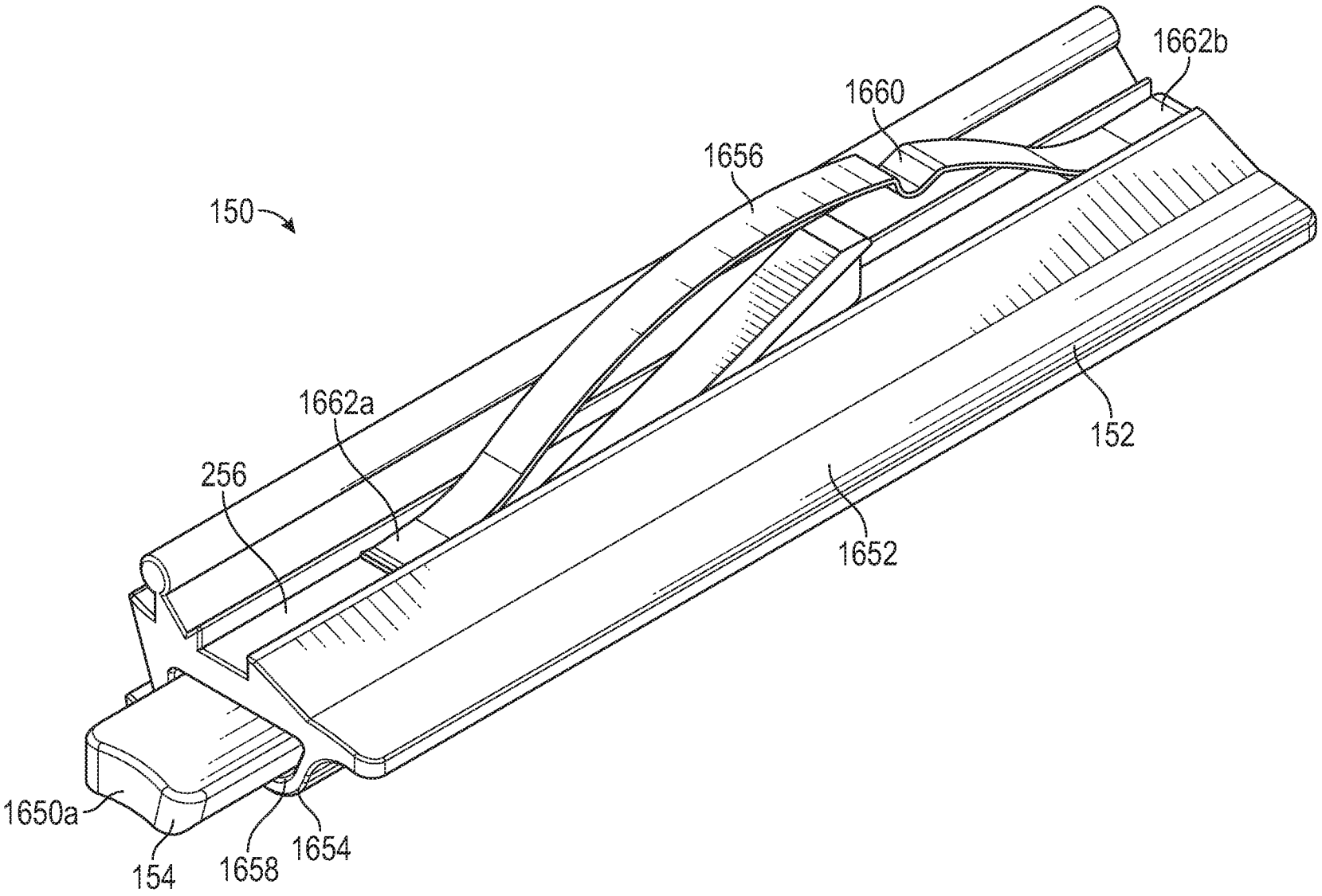
FIG. 16 is a perspective view of another aspect of the window security device in accordance with another aspect of the present disclosure.

FIG. 16 is a perspective view of another aspect of the window security device 150 in accordance with another aspect of the present disclosure. In the present aspect, the pull handle 152 can be an enclosed pull handle 1652. The enclosed pull handle 1652 can define a lip 1654 which can extend beneath the locking bar 154 to secure the locking bar 154 within a locking bar channel 1658. In this aspect, the locking bar 154 may not comprise the guide lugs 454*a,b* (shown in FIG. 4), and the pull handle 152 may not define the lug slot 554 (shown in FIG. 5). The lip 1654 can cover the locking bar 154 to prevent inadvertent contact with the locking bar 154 when a user actuates the window security device 150 by pulling upwards on the enclosed pull handle 1652. In this aspect, the locking bar 154 can be selectively positioned about and between the release position and the secured position by pressing upon opposing ends 1650*a,b* (opposing end 1650*b* shown in FIG. 17A) of the locking bar 154.

Additionally, in the present aspect, the window security device 150 can comprise a bent spring 1656 which can define a free end 1662*a* and a fixed end 1662*b*. The free end 1662*a* can slide within the spring groove 256 to prevent binding of the bent spring 1656 as it compresses and expands. Additionally, the bent spring 1656 can define a bend 1660 which can function as a detent to positively secure the locking bar 154 in either the release position or the secured position while resisting movement between the positions, as further described below with respect to FIGS. 17A and 17B.

Figure 17A:
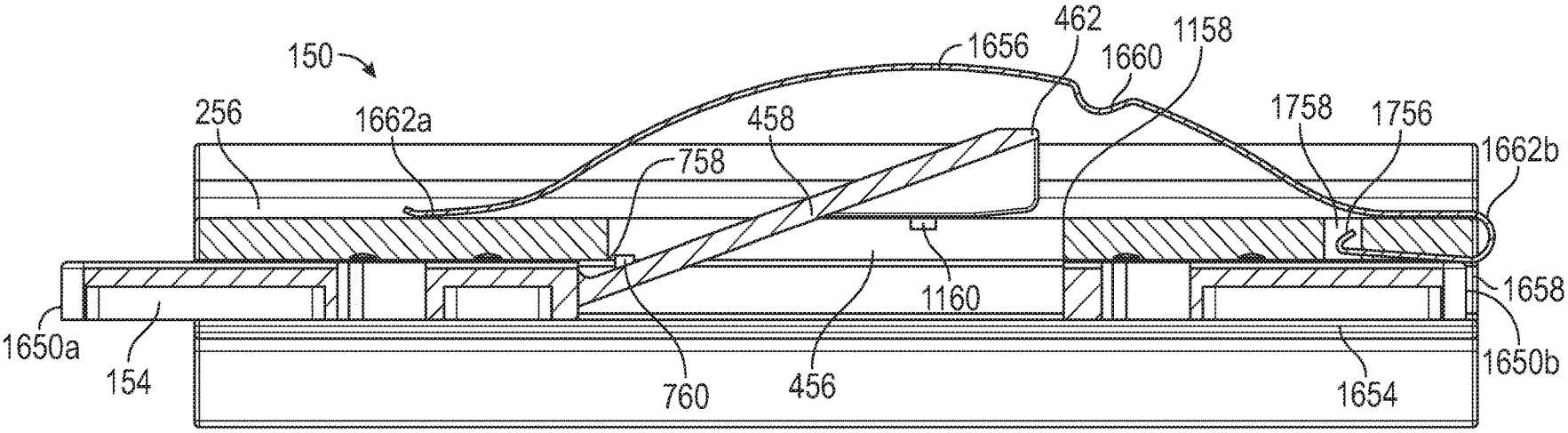
FIG. 17A is a front cross-sectional view of the window security device of FIG. 16 with the locking bar in the release position.

FIG. 17A is a cross-sectional view of the window security device 150 of FIG. 16 with the locking bar 154 in the release position. With respect to the present orientation of the FIG. 17A, the engagement end 462 of the tongue 458 can be positioned to the left of the bend 1660 of the bent spring 1656, relative to the orientation shown. In the present aspect, the bent spring 1656 is shown in a relaxed position. As similarly shown with respect to the spring 156 in FIG. 9, when the window security device 150 is installed on the bottom rail 120 (shown in FIG. 1), contact between the bent spring 1656 and the bottom ledge surface 224 (shown in FIG. 2) of the bottom rail 120 can press the bent spring 1656 downwards towards the enclosed pull handle 1652. Pressing the bent spring 1656 downwards can reduce an arch of the bent spring 1656 and horizontally elongate the bent spring 1656 so that the free end 1662*a* moves towards the end 1650*a* of the locking bar 154. The fixed end 1662*b* can define a clip 1756 which can engage a spring pocket 1758 to secure the fixed end 1662*b* of the bent spring 1656 to the enclosed pull handle 1652.

Additionally, pressing the bent spring 1656 downwards can place the bend 1660 of the bent spring 1656 between the respective positions of the engagement end 462 in the release position and the secured position so that the bend 1660 interferes with the engagement end 462 when selectively repositioning the locking bar 154 about and between the release position and the secured position. Through this interference, the bend 1660 acts as a detent which can positively secure the locking bar 154 in either the release position or the secured position while resisting, but not preventing, movement of the locking bar 154 about and between the secured position and the released position, thereby preventing inadvertent engagement and disengagement of the locking bar 154.

Figure 17B:
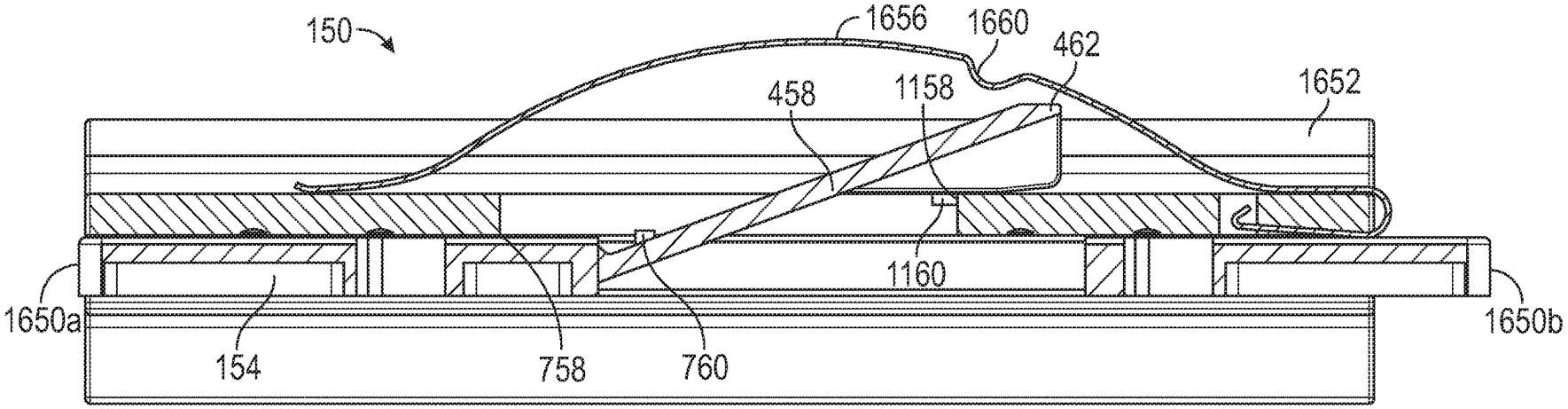
FIG. 17B is a front cross-sectional view of the window security device of FIG. 16 with the locking bar in the secured position.

FIG. 17B is a cross-sectional view of the window security device 150 of FIG. 16 with the locking bar 154 in the secured position. As shown, the bend 1660 is positioned to the left of the engagement end 462, relative to the orientation shown, and when the bent spring 1656 is pressed downwards, the bend 1660 can engage the engagement end 462 to resist movement of the locking bar 154 to the left towards the release position. The locking bar 154 can be selectively positioned about and between the release position and the secured position by pressing on the opposing ends 1650*a,b* to slide the locking bar 154 within the locking bar channel 1658 (shown in FIG. 18).

Figure 18:
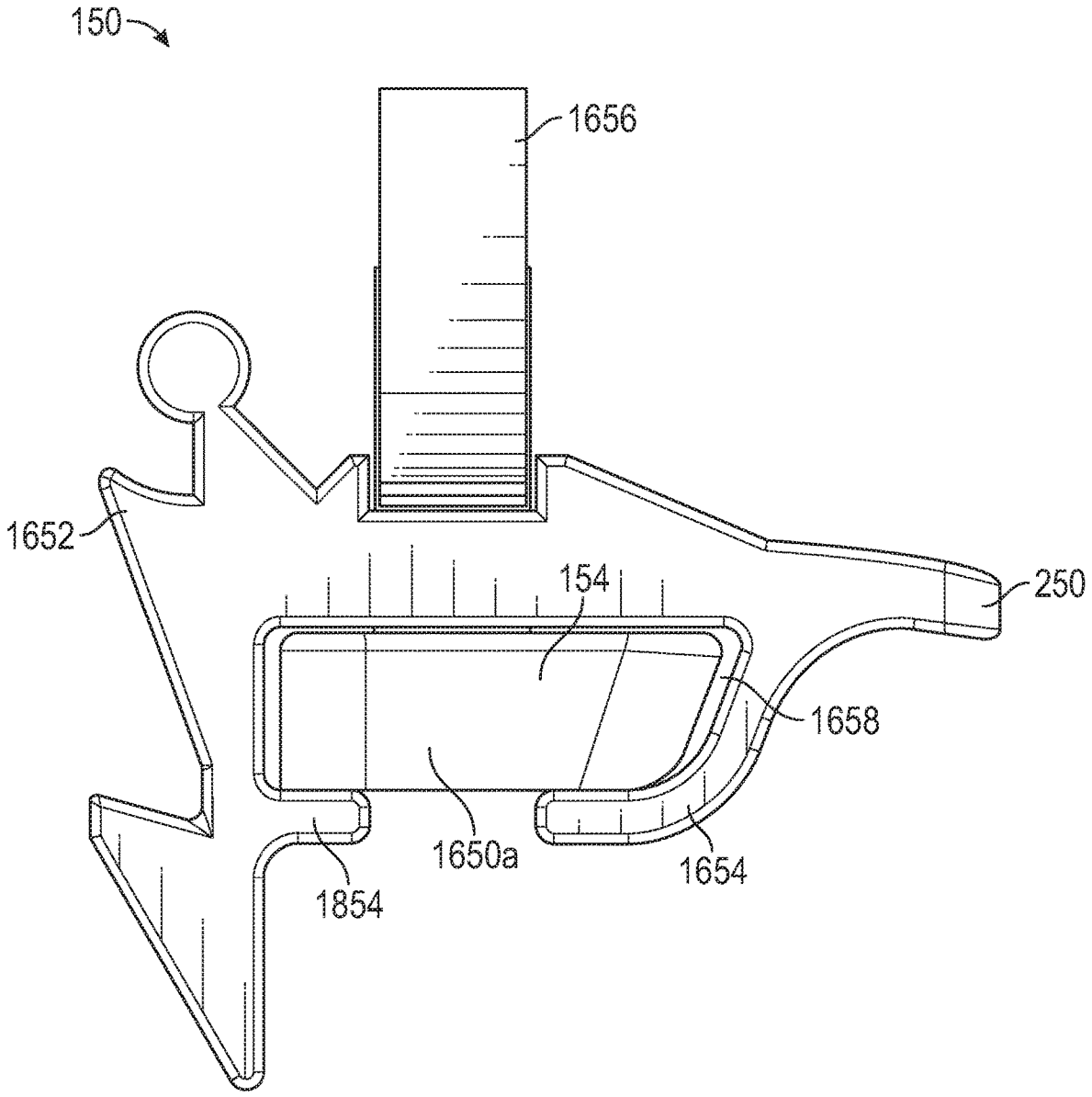
FIG. 18 is an end view of the window security device of FIG. 16 facing an end of the locking bar.

FIG. 18 is an end view of the window security device 150 of FIG. 16 facing the end 1650*a* of the locking bar 154. As shown, the lip 1654 can partially enclose the locking bar channel 1658. A shelf 1854 of the enclosed pull handle 1652 can also partially enclose the locking bar channel 1658 and support the locking bar 154. In some aspects, the lip 1654 and the shelf 1854 can connect, and the locking bar channel 1658 can be fully enclosed. The lip 1654 and the shelf 1854 of the enclosed pull handle 1652 can shield the locking bar 154 from inadvertent contact by a user when the user grips the paddle portion 250 of the enclosed pull handle 1652.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A window security device comprising:

a pull handle, the pull handle defining a top paddle surface and a bottom paddle surface, the top paddle surface defined opposite from the bottom paddle surface, the pull handle defining a tongue slot extending through the pull handle from the top paddle surface to the bottom paddle surface; and a locking bar slidably attached to the pull handle, the locking bar being selectively positionable about and between a secured position and a release position, a locking bar body of the locking bar positioned adjacent to the bottom paddle surface, a tongue of the locking bar extending through the tongue slot and each of the top paddle surface and the bottom paddle surface, an engagement end of the tongue being aligned with the tongue slot and configured to depress into the tongue slot when the locking bar is in the release position, the engagement end of the tongue being misaligned from the tongue slot and being positioned abutting the top paddle surface in the secured position.

2. The window security device of claim 1, wherein:

the window security device is pivotably attached to a bottom rail; and the engagement end of the tongue is positioned in contact with a hand ledge of the bottom rail and the top paddle surface of the pull handle when the locking bar is in the secured position.

3. The window security device of claim 2, wherein:

the window security device is selectively positionable about and between a locked position and an unlocked position; and the window security device is secured in the locked position and prevented from pivoting relative to the bottom rail when the locking bar is in the secured position.

4. The window security device of claim 3, wherein:

the pull handle engages a window sill in the locked position;

the bottom rail is vertically fixed relative to the window sill in the locked position;

the pull handle is disengaged from the window sill when the window security device is in in the unlocked position; and the bottom rail is vertically movable relative to the window sill when the window security device is in the unlocked position.

5. The window security device of claim 1, wherein:
the tongue defines at least one position stop extending into the tongue slot; and
the at least one position stop is configured to engage an edge of the tongue slot to limit travel of the locking bar relative to the pull handle.

6. The window security device of claim 1, wherein:
the locking bar body defines at least one guide lug;
the pull handle defines a lug slot extending into the pull handle from the bottom paddle surface;
the at least one guide lug engages the lug slot; and
the at least one guide lug is configured to translate within the lug slot.

7. The window security device of claim 1, wherein:
the window security device further comprises a bent spring;
the bent spring defines a bend; and
the bend engages the engagement end of the tongue.

8. A window frame assembly comprising:
a window sill defining a sill locking rib;
a rail defining a hand ledge; and
a window security device, the window security device pivotably attached to the rail, the window security device selectively engaging the sill locking rib, the window security device comprising:
a pull handle; and
a locking bar, the locking bar defining a tongue, an engagement end of the tongue positioned in contact with the hand ledge and a top paddle surface of the pull handle, the top paddle surface of the pull handle facing the hand ledge; and
wherein:
the locking bar is selectively positionable about and between a release position and a secured position;
the pull handle further defines a bottom paddle surface positioned opposite from the top paddle surface,
the pull handle defines a tongue slot extending through the pull handle from the top paddle surface to the bottom paddle surface;
the tongue extends through the tongue slot and each of the top paddle surface and the bottom paddle surface;
the engagement end of the tongue is aligned with the tongue slot in the release position; and
the engagement end of the tongue is misaligned with the tongue slot in the secured position.

9. The window frame assembly of claim 8, wherein the engagement end prevents the window security device from pivoting towards the hand ledge when the locking bar is in the secured position.

10. The window frame assembly of claim 8, wherein the engagement end of the tongue is configured to depress into the tongue slot when the locking bar is in the release position.

11. The window frame assembly of claim 8, wherein:
the window security device further comprises a spring; and
the window security device engages the sill locking rib when the window security device is in a locked position;
the window security device disengages the sill locking rib when the window security device is in an unlocked position; and
the spring biases the window security device towards the locked position.

12. The window frame assembly of claim 11, wherein:
the spring defines a bend; and
the bend engages the engagement end of the tongue.

13. A method of operating a window frame assembly comprising a rail, a window sill, and a window security device, the method comprising:
positioning the rail in a closed position wherein the rail rests against the window sill;
positioning the window security device in a locked position, the window security device pivotably attached to the rail, the window security device selectively pivotable about and between the locked position and an unlocked position, the rail vertically fixed relative to the window sill when the rail is in the closed position and the window security device is in the locked position;
repositioning a locking bar of the window security device from a release position to a secured position, the window security device being pivotable from the locked position to the unlocked position when the locking bar is in release position, the window security device being prevented from pivoting from the locked position to the unlocked position when the locking bar is in the secured position; and
sliding the locking bar of the window security device from the secured position to the release position and depressing an engagement end of a tongue of the locking bar into a tongue slot defined by a pull handle of the window security device.

14. The method of claim 13, wherein positioning the window security device in the locked position comprises engaging a handle locking rib of the window security device with a sill locking rib of the window sill.

15. The method of claim 14, wherein positioning the window security device in the locked position further comprises pivoting the window security device away from a hand ledge of the rail.

16. The method of claim 13, wherein sliding the locking bar of the window security device from the release position to the secured position comprises positioning the engagement end of the tongue between a hand ledge of the rail and a pull handle of the window security device, the tongue defined by the locking bar.

17. The method of claim 13, wherein sliding the locking bar of the window security device from the release position to the secured position comprises misaligning the engagement end of the tongue of the locking bar with the tongue slot defined by a pull handle of the window security device.

18. A window security device comprising:
a pull handle, the pull handle defining a top paddle surface and a bottom paddle surface, the top paddle surface defined opposite from the bottom paddle surface, the pull handle defining a tongue slot extending through the pull handle from the top paddle surface to the bottom paddle surface, the pull handle defining a lug slot extending into the pull handle from the bottom paddle surface; and
a locking bar slidably attached to the pull handle, a locking bar body of the locking bar positioned adjacent to the bottom paddle surface, the locking bar body defining at least one guide lug, the at least one guide lug engaging the lug slot, the at least one guide lug configured to translate within the lug slot, a tongue of the locking bar extending through the tongue slot and each of the top paddle surface and the bottom paddle surface.

19. The window security device of claim 18, wherein:
the window security device is pivotably attached to a bottom rail; and an engagement end of the tongue is positioned in contact with a hand ledge of the bottom rail and the top paddle surface of the pull handle when the locking bar is in a secured position.

20. The window security device of claim 19, wherein:

the window security device is selectively positionable about and between a locked position and an unlocked position; and the window security device is secured in the locked position and prevented from pivoting relative to the bottom rail when the locking bar is in the secured position.

21. A method of operating a window frame assembly comprising a rail, a window sill, and a window security device, the method comprising:

positioning the rail in a closed position wherein the rail rests against the window sill;

positioning the window security device in a locked position comprising:

engaging a handle locking rib of the window security device with a sill locking rib of the window sill; and pivoting the window security device away from a hand ledge of the rail, the window security device pivotably attached to the rail, the window security device selectively pivotable about and between the locked position and an unlocked position, the rail vertically fixed relative to the window sill when the rail is in the closed position and the window security device is in the locked position; and repositioning a locking bar of the window security device from a release position to a secured position, the window security device being pivotable from the locked position to the unlocked position when the locking bar is in release position, the window security device being prevented from pivoting from the locked position to the unlocked position when the locking bar is in the secured position.

22. The method of claim 21, wherein repositioning the locking bar of the window security device from the release position to the secured position comprises misaligning an engagement end of a tongue of the locking bar with a tongue slot defined by a pull handle of the window security device.

23. The method of claim 21, wherein repositioning the locking bar of the window security device from the release position to the secured position comprises positioning an engagement end of a tongue between the hand ledge of the rail and a pull handle of the window security device, the tongue defined by the locking bar.

24. A method of operating a window frame assembly comprising a rail, a window sill, and a window security device, the method comprising:

positioning the rail in a closed position wherein the rail rests against the window sill;

positioning the window security device in a locked position, the window security device pivotably attached to the rail, the window security device selectively pivotable about and between the locked position and an unlocked position, the rail vertically fixed relative to the window sill when the rail is in the closed position and the window security device is in the locked position; and repositioning a locking bar of the window security device from a release position to a secured position comprising misaligning an engagement end of a tongue of the locking bar with a tongue slot defined by a pull handle of the window security device, the window security device being pivotable from the locked position to the unlocked position when the locking bar is in release position, the window security device being prevented from pivoting from the locked position to the unlocked position when the locking bar is in the secured position.

25. The method of claim 24, wherein repositioning the locking bar of the window security device from the release position to the secured position comprises positioning the engagement end of the tongue between a hand ledge of the rail and the pull handle of the window security device, the tongue defined by the locking bar.

* * * * *